United States Patent [19]

Forsythe

[11] Patent Number: 4,735,026

[45] Date of Patent: Apr. 5, 1988

[54] INSULATION CEILING ASSEMBLY

[76] Inventor: Frank E. Forsythe, Box 308A, Decherd, Tenn. 37324

[21] Appl. No.: 902,210

[22] Filed: Sep. 2, 1986

[51] Int. Cl.[4] ..... E04B 1/82; E04B 2/28

[52] U.S. Cl. ..... 52/404; 52/145; 52/407; 52/506; 52/650

[58] Field of Search ..... 52/506, 509, 144, 145, 52/404, 406, 407, 309.7, 309.11, 646, 648, 650, 660, 664, 695, 712, 713, 714, 649, 645, 408, 410

[56] References Cited

U.S. PATENT DOCUMENTS

| | | | |
|---|---|---|---|
| 2,148,496 | 2/1939 | Park | 52/407 X |
| 2,179,678 | 11/1939 | Wenzel | 52/407 |
| 2,239,394 | 4/1941 | Mackechnie | 52/407 |
| 2,335,968 | 12/1943 | Sawtell | 52/407 X |
| 3,751,869 | 8/1973 | McDonald et al. | 52/650 |
| 3,969,863 | 7/1976 | Aiderman | 52/407 |
| 4,040,212 | 8/1977 | Göransson | 52/145 |
| 4,147,003 | 4/1979 | Alderman | 52/407 X |
| 4,375,741 | 3/1983 | Paliwoda | 52/404 X |
| 4,434,601 | 3/1984 | Zellmer | 52/407 X |
| 4,441,294 | 4/1984 | Riley | 52/664 X |

FOREIGN PATENT DOCUMENTS

| | | | |
|---|---|---|---|
| 2006313 | 5/1979 | United Kingdom | 52/407 |

OTHER PUBLICATIONS

Certaspray® Fiber Glass Spray Insulation product brochure, ©1984, Certain Teed Corporation.

IV Due-O-Wall® Source Book, product brochure, ©1984, Dur-O-Wall, Inc.

*Primary Examiner*—Henry E. Raduazo
*Assistant Examiner*—Richard E. Chilcot, Jr.

[57] ABSTRACT

An insulation ceiling assembly which may be affixed to bar joists or purlins to allow installation of building insulation below the roof. The assembly may be used with both metal deck and standing seam style roofs without interference to fixtures, tubing or other apparatus running underneath. The invention is comprised of parallel truss members attached and running perpendicularly to roof bar joists or purlins; interlocker connectors connecting, at regular intervals, the tops of truss members in pairs and so as to prevent lateral buckling of the truss members and to form a rigid truss-interconnector lattice; parallel rows of insulation material positioned parallel to and between the truss members; supporting rods and wire mesh running below the insulation and parallel to the lower end of the interlocker connectors so as to hold the insulate material in place and provide a ceiling frame; and a reflective water-permeable spray insulation which thinly coats the under portion of the assembly and which seals cracks and thermal leaks incidental to the truss-interconnector lattice or intruding conduit, plumbing, fixtures and the like. This invention also details a thermal insulation process which may be used in conjunction with the insulation ceiling assembly.

9 Claims, 4 Drawing Sheets

INSULATION CEILING ASSEMBLY

BACKGROUND OF THE INVENTION

The present invention pertains to thermal insulation methods and assemblies for industrial building ceilings. In most commercial settings where steel roofs are found, built-up-roofing (hereinafter "B.U.R.") insulation methods are employed. B.U.R. involves the attachment of rigid insulation on top (i.e., outside) of the roof by affixing a lamination of rigid insulation board, tar paper, gravel and the like. The B.U.R. process, however, is costly and produces only moderate quality thermal insulation. Furthermore, the B.U.R. process can only be applied to metal deck type roofs; it is useless on the low cost standing seam roof which is popular with present day architects.

The author knows of no commercialy acceptable insulation method which can be applied below, rather than above, the roof. Because of the difficulty inherent in working among the bar joists or purlins which support the roof and the attached conduit and fixtures, the only acceptable exposed surface currently available is spray applied fiberglass. Spray fiberglass provides a tight thermal barrier, optical reflection and a neat ceiling appearance around the intricate arrangement of metal bars, pipes and machines attached to the bar joists or purlins for support; however, spray fiberglass applied in more than a thin coating is cost prohibitive, structurally unsound, and overall has little insulating value.

Thus, a need exists for a low cost thermal insulation system/structure which may be used inside—beneath the roof—which provides good thermal insulating properties, pleasing aspect, optical reflection (for maximum ambient light efficiency) and water permeability (to prevent roof rust). The present invention is directed to this specific need.

SUMMARY OF THE INVENTION

The present invention teaches a ceiling insulation assembly which may be installed among or under the purlins or upper bar joists of metal buildings. The invention incorporates the following features:

(a) parallel rows of truss members having principal strength along the vertical axis which are attached and positioned perpendicular to the roof purlins or bar joists by means of hooks, wires or other manufactured couplers;

(b) regularly spaced interlocker connectors which provide a brace for pairs of truss members along the upper horizontal axis and which superpose and run vertically down sides of each truss pair so connected, and terminate in a hook at each interlocker end below the truss members;

(c) continuous bats of light density thermal insulation material running between the voids created by the parallel truss members;

(d) chicken wire or similar lightweight wire mesh fastened to the interlocker hooks which cover the bottom of the thermal insulation material;

(e) parallel rows of support rods resting in and supported by the hooked ends of the interlocker connectors, so as to run underneath the insulation material and wire mesh, perpendicular to the parallel rows of truss members; and (f) spray applied insulation material covering the underside of the isulation bats, interlocker hooks, wire mesh and support bars.

The principal objective of the invention is to provide a low cost insulation ceiling assembly with good thermal insulation properties that can be mounted beneath metal roofs of commercial buildings.

It is another objective of the invention to provide a ceiling insulation assembly that requires little skill or few tools to install.

The heart of the invention is the truss-interlocker lattice arrangement. Both elements are lightweight, inexpensive and easily handled by unskilled personnel. The parallel array of truss members run perpendicular to the roof bar joists or purlins (whichever is in use as a support) and may attach at any point. As positioned in the invention, the flat thin gauge truss members provide excellent resistance to vertical force and weight as long as they are stabilized or restrained horizontally to prevent buckling or degenerative moments along the horizontal axis. Thus, the interlocker connectors, which connect to and expand perpendicularly across the tops of each pair of parallel truss members, add important composite strength to the truss member arrangement.

The interlocker connectors are designed with quick snap connector means which lock and fasten onto the tops of two truss members at regular intervals. The interlocker connectors continue to extend vertically down the sides of the inter-locked truss members and terminate below the truss members in hooks which are used to lock easily onto the ceiling without the need of tools.

The truss-interlocker arrangement, once assembled, can support almost any depth of light density insulation material such as fiberglass. As the depth of insulating material increases, the truss member height (along its vertical axis) should, however, increase proportionally. Light density insulation is cut to widths slightly greater than the separation distances between the parallel truss members and rolled out parallel to and between the truss members so that it is held in place by friction. A parallel arrangement of support bars connects to the hooked ends of the interlocker connectors and runs underneath and perpendicular to the truss members. This gives additional support to the lightweight insulation material.

Wire mesh, such as chicken wire, can also be attached with the support rods to the hooked ends of the interlocker connectors. The support rods and wire mesh provide the structural components of a ceiling. The ceiling can be thinly sprayed with an insulation glue mixture, such as CERTASPRAY, which covers the cracks between the insulation and building conduit which can cause thermal leaks. An insulation spray which is textured and white is most desirable because it gives a pleasing appearance and well reflects ambient light. The spray insulation should, additionally, be water permeable so that moisture is not trapped by the invention where it may ultimately cause rusting along the roof components.

In the past, it has been extremely difficult to construct insulation assemblies around the diagonal webs of bar joists. The author knows of no other assembly or procedure capable of producing high quality thermal insulation with comparable simplicity or ease.

Other objects and advantages of the invention will be apparent from the following description, the accompanying drawings and the appended claims.

DETAILED DESCRIPTION

Figure 1:
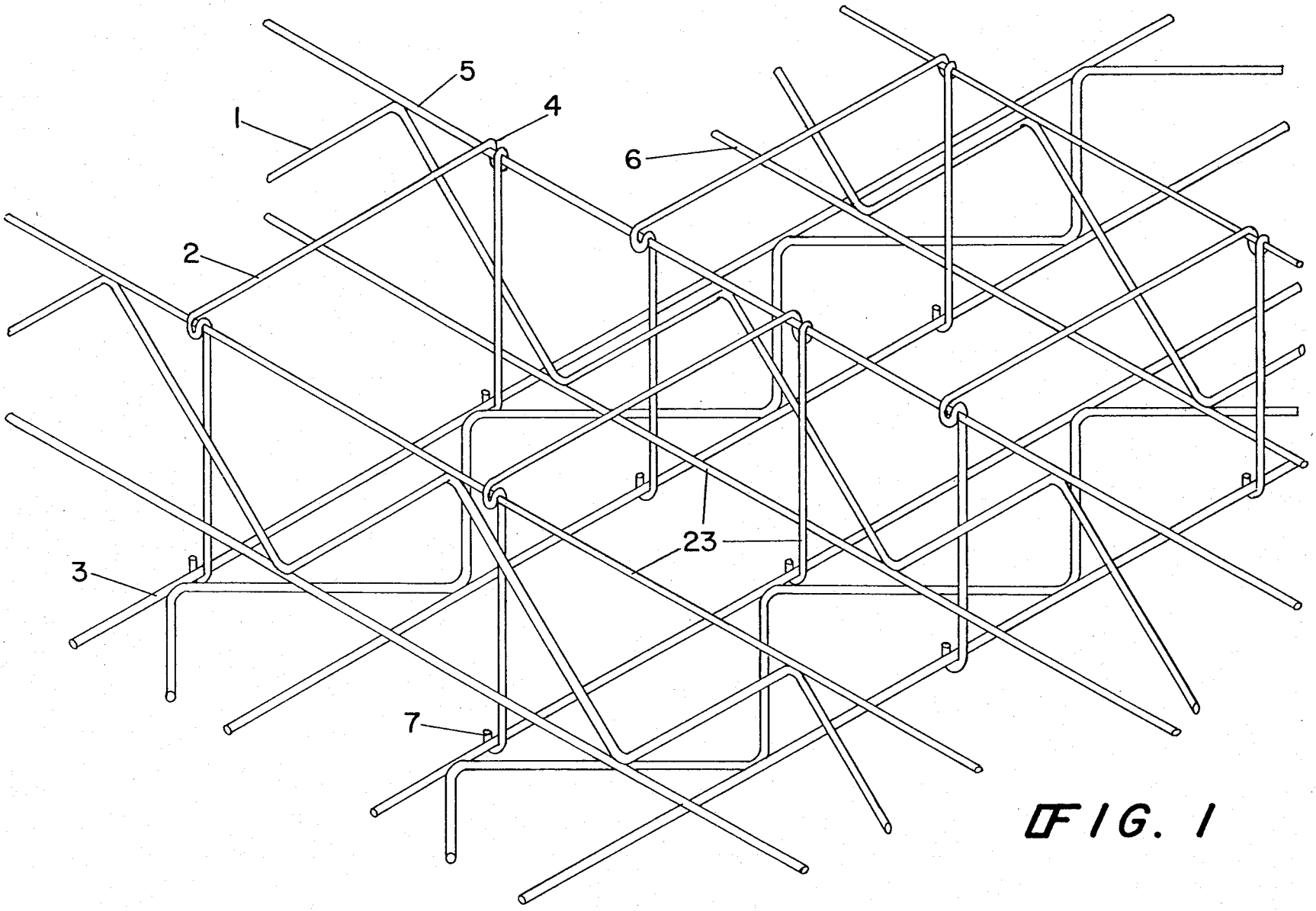
FIG. 1 shows an isometric view of the truss-interlocker lattice.

Referring to FIG. 1, the truss-interlocker lattice 23 of the invention is shown which provides the main support frame for insulation material (not shown). The trussinterlocker lattice 23 is shown unconnected to bar joists or purlins. Each flat truss 1 is secured and kept vertically aligned by the interlocker connectors 2. Lower support rods 3 are used to support insulation material. These three components lock together to form the structural skeleton of the lattice assembly.

As shown, the interlocker connector 2 has upper fasteners 4 which easily snap over the top cords 5 of the flat trusses 1. In the preferred embodiment, the interlocker connectors are placed every 16 inches apart, but each row of interlockers is staggered from the preceeding row. This staggered arrangement functions to support these top cords 5 every 8 inches. This close securement of the top cords 5 assues that these top cords cannot buckle or bend. As has long been known about a truss, which is supported only at the ends, the bottom cord will be under tension, and the top cord under compression. When the invention employs the DUR-O-WAL flat truss, the top cord should be either 9 gauge (which is standard) or 3/16 inch (which is the heavy duty). When a steel rod is positioned so that it can only bend within 8 inch sections, it achieves ample strength. These same rods in the lower cords 6 which are under tension are, of course, also structurally solid. Most buildings, whether framed with bar joists or purlins, will have these truss members spaced about five feet apart. Using these DUR-O-WAL trusses on 16 inch centers attached every five feet to the roof framing members, and with their top cords secured every 8 inches creates a very strong assembly.

The interlockers have lower hooks 7 which serve to support the lower support rods 3. These hooks 7 project several inches below the trusses 1. In the preferred embodiment of this invention an eight inch truss and a twelve inch interlocker are used. At these specifications the interlocker will be equal in depth to the depth of the insulation being used.

Figure 2:
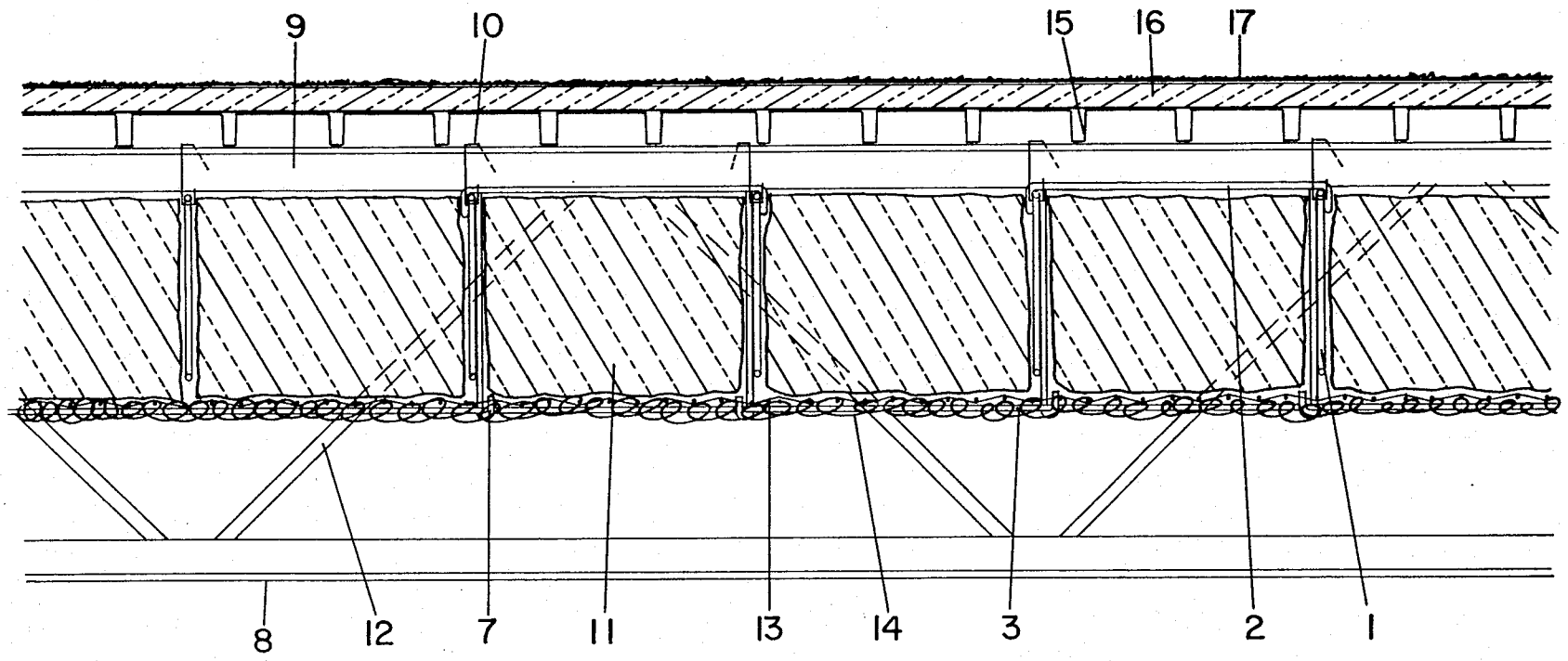
FIG. 2 is a longitudinal cross-sectional view of the invention as used in conjunction with a bar joist supported steel deck roof, wherein the view is along the truss member axis.

Referring to FIG. 2, the invention is shown installed within the upper region of bar joist roof framing 8. This ceiling assembly could be attached to the bottom of these bar joists; however, in most industrial uses the lower section of the bar joist is reserved for the attachment of mechanical and electrical apparatus. Trusses 1 attach to the top cords 9 of these bar joists by steel wires 10. As these trusses 1 are installed, the bottom cord 6 may have to be cut in order to be positioned on the required 16 inch centers. The trusses 1, which are usually in 10 or 20 footlengths, are fed up through the open area of the bar joists. As each truss 1 is installed, the corresponding interlockers 2 are also installed. Next, the 12 inch deep bat of light density insulation 11—typically fiberglass—is positioned. Insulation 11 should be cut to a length equal to, or one inch greater than, the spacing of the bar joist. In this way the fiberglass will compress around the diagonal webs 12 of the bar joists and remain in place. In the case of a building where a drop ceiling is planned, the ceiling would be completed by attaching the lower support rods 3 by simply laying them into the hooks 7. These lower support rods could also consist of 8 inch DUR-O-WAL trusses 1 positioned horizontally rather than vertically. However, in most cases the assembly will be left exposed or codes will require some covering to prevent fibers from becoming dislodged. In these cases, after the fiberglass has been installed, chicken wire 13 or a similar close weave material should be rolled out and pushed up and attached to the lower hooks 7. After the chicken wire has been temporarily hung, the lower support rods 3 will be positioned by simply being laid into the lower hooks 7.

After the unskilled labor is completed, a spray insulation is applied to provide a visually appealing ceiling and to seal cracks which could otherwise cause thermal leaks. CERTASPRAY 14, a combination of loose fiberglass fibers and a latex glue, will easily penetrate the chicken wire 13 and build up to a depth of ½ to ¾ inch. This will completely cover all of the galvanized steel components and become very stable. The steel of the support rods and the chicken wire act as a skeleton to which this fiberglass and glue adhere.

Also shown in this figure are the components of a typical flat metal roof. The steel deck 15 is shown above the bar joist. Rigid fiberglass insulation 16 and built up roofing 17 are also shown.

Figure 3:
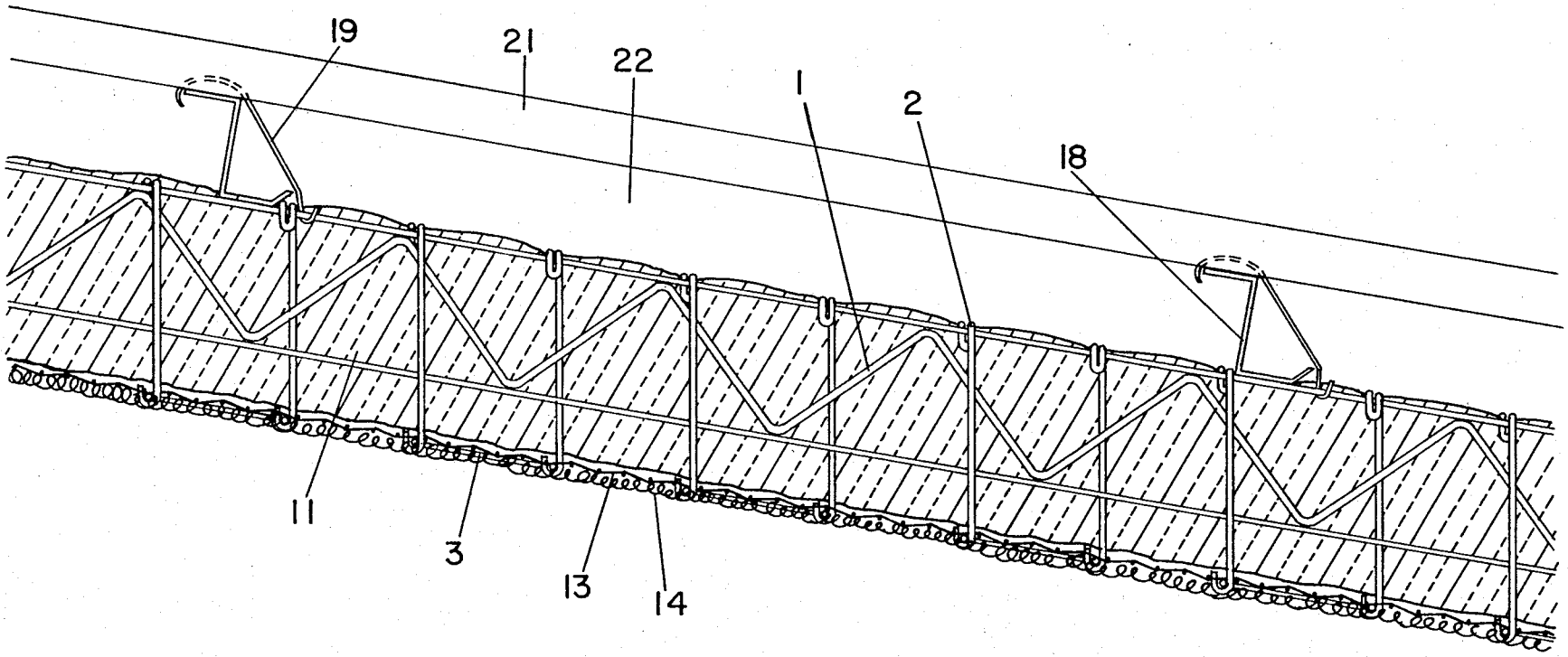
FIG. 3 is a longitudinal cross-sectional view of the invention used in conjunction with a purlin supported slant roof, wherein the view is along the purlin axis.

Referring to FIG. 3, the invention is shown suspended beneath the purlin 18 roof framing members of a metal building. Trusses 1 are attached to said purlins 18 by steel wires 19 or clips. In this embodiment of the invention, there is a six inch deep air space 22 between the trusses 1 and the roof 21. When air vents (not shown) are located at the ridge or eaves of the roof (not shown), air can circulate through this entire air space 22 removing rust producing moisture. And, in warm seasons, this not only eliminates moisture buildup but also helps cool the building.

Figure 4:
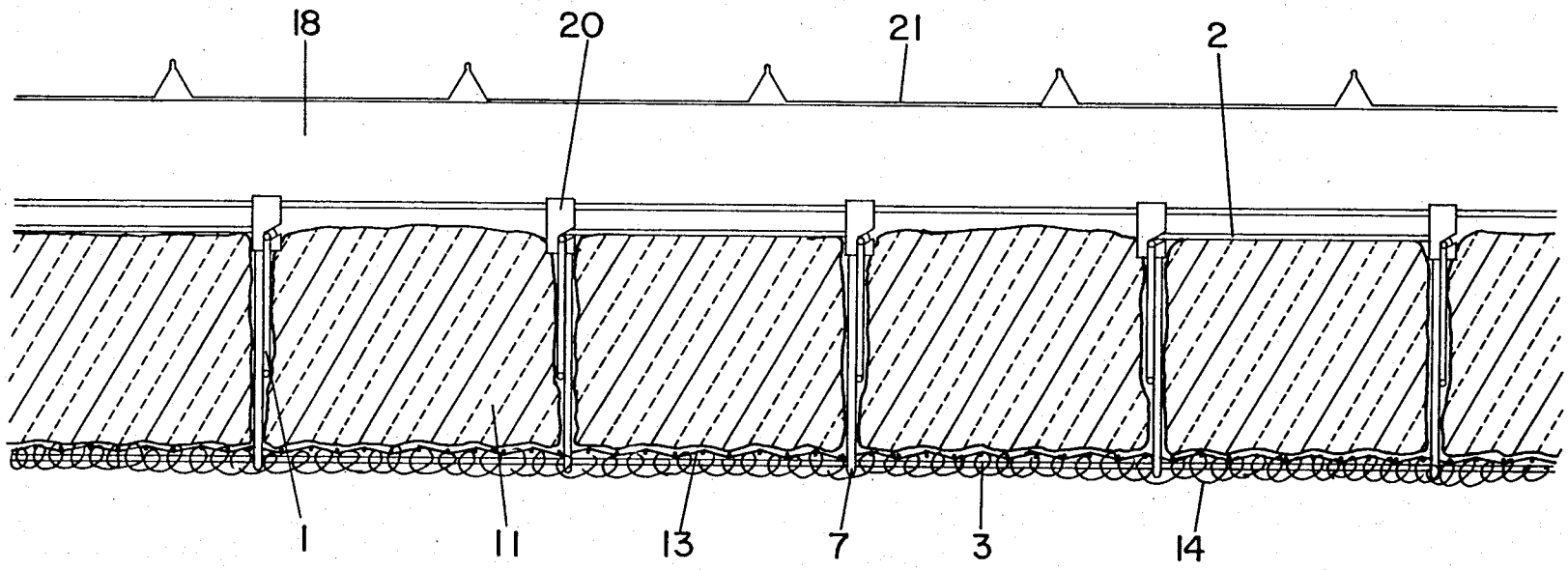
FIG. 4 is a longitudinal cross-section of the invention used in conjunction with a purlin supported standing seam roof, wherein the view is along the truss member axis.

FIG. 4 shows the invention along the truss member axis. Here a pre-manufactured clip 20 is used to suspend the trusses 1. Again CERTASPRAY 14 or the like covers the support rods 3 and chicken wire 13. Again, the 12 inch fiberglass bat 11 is snugly fitted into the void created in the hanging assembly. These bats 11 will come from continuous rolls which will be rolled out from the walls to the ridge. It is advisable during new construction to assemble the hanging assembly, which is simply the Truss and the Interlocker, before placing the insulation. In this way the electricians and plumbers can stub down any apparatus that must be affixed. Also when equipment will be hung from the purlins, hanging mechanisms should first be stubbed down to receive these. After this is completed, insulation workers can easily cut the fiberglass bats 11, chicken wire 13 and support rods 3 so as to avoid these obstacles. The cuts will not have to be perfect because the insulation spray will easily fill and cover all the gaps. The end result is a level, continuous ceiling that is insulating, optically reflective and visually appealing.

In the event that work is necessary at some later date above the ceiling, it will be easy to cut out the desired regions, and do the work. Afterward, the insulation component can be replaced. Many of the lower interlocker hooks 7 will probably still be usable; if not, the support rods can be wired in place. Insulation spray application recloses all these new openings. Also with spray insulations such as CERTASPRAY the ceiling may be repainted at will.

In recent years stricter laws have passed regulating noise levels in the work place. Uninsulated roofs act much like a drum. With the use of this invention, however, there is a marked decrease in ambient noise reflection or resonance.

The invention is as applicable for old buildings as it is new ones. In new buildings, however, the invention permits the adding of insulation before the roof is completed.

As an example, on a metal building, the entire truss-interlocker lattice assembly may be installed with chicken wire and a loose fill insulation material, such as rock wool, can be "poured" into the assembly between the parallel array of truss members. The chicken wire, in this usage, acts not only as a skeleton frame for the spray application of a following glue-insulation coating, but also supports the loose fill to prevent leakage of the insulation material.

I claim the following:

1. A thermal, or sound insulation ceiling assembly which may be fastened directly or indirectly to bar joists, purlins or other interior supports of a building comprising:

a parallel array of truss members having a void between such truss member and oriented so as to restrain forces applied along the vertical axis and not along the horizontal axis;

a plurality of parallel interlocker rods each having a middle section which connects and braces the tops of a pair of adjacent truss members along a horizontal axis perpendicular to said truss members, and having end sections bent at right angles to said middle section which ends extend downward and perpendicular to each of said pair of truss members and terminate in hooked ends below said each pair of truss members; and a parallel array of support rods running horizontally, beneath and perpendicular to said truss members, and which connect with and are held in place by said interlocker hooks so as to provide support for insulation bats.

2. The insulation ceiling assembly of claim 1 wherein said light density insulation bats are composed of fiberglass cut in widths equal to or greater than width of said void between said pair of adjacent truss members.

3. The insulation ceiling assembly of claim 1 wherein said parallel array of support rods, said interlocker hooks, and said light density insulation exposed at the underportion of said insulation ceiling assembly are covered with a spray or brush applied insulation-glue mixture between 1/16" and 11" in thickness, which provides an insulation seal around all cracks, obstructions or other thermal leaks.

4. The insulation ceiling assembly of claim 1 wherein said parallel array of support rods, said interlocker hooks and said light density insulation exposed at the under portion of said insulation ceiling assembly are covered with a spray or brush applied insulation-glue mixture between 1/16" and 11" in thickness, which is optically reflective and water permeable.

5. The insulation ceiling assembly of claim 1 wherein the said plurality of parallel interlocker rods each contain a middle section which connects and braces the tops of said pair of adjacent trusses by means of snap-on fasteners.

6. The insulation ceiling assembly of claim 1 wherein the plurality of parallel interlocker rods are spaced apart at regular intervals, "w," alternately commencing at some arbitrary point x on each even numbered pair of truss pair, and point $x+w/2$ on the adjacent odd numbered truss pair.

7. A process for affixing thermal insulation underneath building roofs such as found in industrial and commercial settings which comprises the following steps:

securing a parallel array of truss members to a supporting member of the building roof, such as the bar joists or purlins, so that each truss member is oriented to restrain forces in the vertical direction and so that the parallel array of said truss members runs prependicular to the axis of sad building roof supporting member;

fastening at regular intervals, "w," a plurality of parallel interlocker rods, each having a middle section, end sections bent at right angles to said middle section and terminate in interlocker hooks, said middle section connects and braces the tops of each pair of parallel truss members alternately commencing at some arbitrary point x on each evenly numbered truss pair, and point $x+w/2$ on the adjacent odd numbered truss pair so as to create a lattice assembly with composite strength in both horizontal and vertical axes;

cutting light density thermal insulation in bats with thickness equal to or greater than the distance of separation between the parallel or truss members and position said light density thermal insulation between the parellel truss members; and attaching a parallel array of support rods horizontally, beneath and perpendicular to said truss members which connect with and are held in place by to said interlocker hooks so as to provide support for said insulation batts.

8. The insulation process of claim 7 wherein said parallel array of support rods interlocker hooks and light density insulation exposed at the underportion of the assembly, is sprayed or brushed with an insulation-glue mixture between 1/6" and 11" thickness so as to provide an insulation seal around all cracks, obstructions or other thermal leaks.

9. In a building having standing seam or steel deck-roofing an improved roof consisting a parallel array of truss members having a void between such truss members and oriented so as to restrain forces applied along the vertical axis and not along the horizontal axis;

a plurality of parallel interlocker rods each having a middle section which connects and braces the tops of a pair of adjacent truss members along a horizontal axis perpendicular to said truss members, and having end sections bent at right angles to said middle section which ends extend downward and perpendicular to each of said pair of truss members and terminate in hooked ends below said each pair of truss members; and a parallel array of support rods running horizontally, beneath and perpendicular to said truss members, and which connect with and are held in place by said interlocker hooks so as to provide support for said insulation batts attached to purlins, bar joists or other roof supporting structure so as to permit the roof to support below roof insulation.

* * * * *